United States Patent [19]

Brockhaus et al.

[11] Patent Number: 4,628,567

[45] Date of Patent: Dec. 16, 1986

[54] DOOR HINGE ASSEMBLY FOR MOTOR VEHICLES ENABLING DISMOUNTING AND REMOUNTING OF THE DOOR DURING ASSEMBLY

[75] Inventors: Ernst Brockhaus, Remscheid-Hasten; Karl-Heinz Tölle, Wuppertal, both of Fed. Rep. of Germany

[73] Assignee: Ed. Scharwachter GmbH & Co, KG.

[21] Appl. No.: 751,084

[22] Filed: Jul. 2, 1985

[30] Foreign Application Priority Data

Jul. 2, 1984 [DE] Fed. Rep. of Germany ..... 3424331

[51] Int. Cl.[4] ..... E05D 7/10; E05D 5/10

[52] U.S. Cl. ..... 16/267; 16/254; 16/332

[58] Field of Search ..... 16/265, 266, 267, 284, 16/332, 334, 254, 257, 256, 303

[56] References Cited

U.S. PATENT DOCUMENTS

| | | | |
|---|---|---|---|
| 3,117,340 | 1/1964 | Arboll | 16/303 |
| 3,744,085 | 7/1973 | Griego | 16/386 |
| 4,073,038 | 2/1978 | Curry et al. | 16/50 |
| 4,485,522 | 12/1984 | Chen | 16/303 |
| 4,494,273 | 1/1985 | Straus | 16/303 |
| 4,528,718 | 7/1985 | Brockhaus | 16/266 |

FOREIGN PATENT DOCUMENTS

| | | | |
|---|---|---|---|
| 2106587 | 4/1983 | United Kingdom | 16/265 |

*Primary Examiner*—M. Jordan

*Attorney, Agent, or Firm*—Toren, McGeady, Stanger, Goldberg & Kiel

[57] ABSTRACT

A hinge assembly particularly for the door of a motor vehicle enabling the door to be removed and replaced during assembly of the motor vehicle, wherein a first and a second hinge member are engaged on a hinge pin with the first hinge member being freely rotatable relative to the hinge pin, but axially fixed relative thereto and wherein the second hinge member is axially movable relative to the hinge pin, but capable of being placed in nonrotative locking engagement therewith in the assembled condition of the vehicle, the assembly being provided with spring-loaded carrier engaging the second hinge member and the hinge pin to ensure fixed rotative engagement therebetween in the assembled condition of the vehicle.

17 Claims, 9 Drawing Figures

DOOR HINGE ASSEMBLY FOR MOTOR VEHICLES ENABLING DISMOUNTING AND REMOUNTING OF THE DOOR DURING ASSEMBLY

The present invention is directed generally to door hinge assemblies and more particularly to a door hinge assembly especially adapted for use with motor vehicles.

The invention is particularly directed to the type of hinge assembly which is operable to enable the door of a motor vehicle to be dismounted or unhinged during assembly of the vehicle and then remounted without giving rise to dislocations of the door during the manufacturing process.

Hinge assemblies of the type to which the present invention relates will generally consist of a first and a second hinge member, one being attached at a door mounting part and the other attached with the door itself, each of the members having a hinge eye into which a hinge pin engages. One of the hinge members engages the hinge pin so as to be freely rotatable relative thereto while being secured against relative axial movement. The other hinge member is usually arranged so as to be nonrotatively interengaged with the hinge pin, but capable of being axially dismounted therefrom and remounted thereon. The first hinge member is usually mounted on the hinge pin by means of a bushing of bearing material with a running fit. Furthermore, the two hinge members are usually arranged so that they are locked in place against axial relative displacement along only a predetermined operating swivelling angle of the hinge assembly by means of reciprocally arranged projections and recesses which are defined in the circumferential direction and which engage in one another over the operating swivel angle area of the hinge.

The hinge eye of the second or removable hinge member may be formed with a short chamfered, frontally toothed collar with the second hinge half being formed with a corresponding counter-profiling at the lower side or face of the hinge eye in order to maintain nonrotative relative engagement between the second hinge member and the hinge pin while permitting relative axial movement therebetween.

Removable door hinges of the type to which the present invention relates are used currently in the production of motor vehicles so as to enable proper fitting and adjustment of the doors in the vehicle during the manufacturing procedures. The hinge assemblies operate so that the doors can be removed from the vehicle body during assembly of the vehicle so that the vehicle may be equipped with the necessary operating parts. After removal, the doors may again be installed on the vehicle body in the position in which they were originally fit so as to be exactly aligned with the door openings of the vehicle body without requiring additional adjustment or other work.

Such removability of vehicle doors during assembly of the equipment of the vehicle offers a particular advantage in that it facilitates accessability to the interior of the vehicle during assembly operation in a time saving manner.

Removable door hinge assemblies known in the prior art consist of two hinge halves or members, each of which is fastened so as to be immovable at one of the door arrangement parts, either the door or the door beam in the unfinished state of the vehicle and in a position corresponding to the completely adjusted position of the vehicle door. Another of the hinge parts receives the hinge pin including the maintenance-free bearing or bushing member. In contrast to such unhingeable or removable door hinge assemblies, wherein the hinge pin must be removed by means of separating the door hinge, separable door hinges of this type of construction offer the advantage that the vehicle doors can more easily be replaced on the hinges again, since the hinge pin is permanently supported in one of the hinge halves. The maintenance-free bearing of the hinge pin also has a simpler construction. However, since the hinge pin is fundamentally rotatably supported in one hinge half so as to be maintenance-free, it must be ensured that when the door hinge is installed, there is a satisfactory support of the hinge pin by means of the second or unhingeable hinge half when the vehicle door is opened or closed. This support of the hinge pin by means of the second, unhingeable hinge member or half is achieved in accordance with the prior art in a known type of construction of an unhingeable door hinge assembly disclosed in DE-OS No. 31 37 112. In this device, the hinge pin is provided with a radially projecting collar having a toothed configuration and the second or removable hinge member is formed with a complementary toothed profiling at the lower face of its hinge eye. The toothed configuration of the hinge pin and the hinge eye are constructed so as to be shaped in the form of a truncated cone or frustum in order to ensure automatic mutual engagement or meshing of the toothed portions when mounting the second hinge half on the hinge pin. In order to achieve the intended purpose of enabling removal and replacement of the door of the motor vehicle during assembly, it is necessary that the connection between the hinge eye of the removable hinge half and the hinge pin, which connection excludes their relative rotation, be effected already in the first rotational movement of the replaced vehicle door. However, if unhingeable door hinges in which the connection between the hinge pin and the hinge eye of the unhingeable hinge half is effected by axially arranged teeth constructed in opposite directions, it may occur that the teeth for the connection of the hinge eye and the hinge pin will not engage or lock against relative rotation during the first phase of rotational movement therebetween. This may occur, for example, because, when installing the vehicle door, the tips of the teeth of the two respective toothed configuration may lie one on the other giving rise to a result that a connection between the hinge eye and the hinge pin, which must operate to secure these parts against relative rotation, will first occur at a point in time not previously determined. However, since a delayed engagement or connection between the hinge pin and the hinge eye of the removable hinge half may result in considerable disadvantages, provision must be made in order that the nonrotatable connection between the hinge pin and the hinge eye of the second or removable hinge half is effected in the first rotational movement of the replaced vehicle door.

Accordingly, the present invention is directed toward providing a door hinge apparatus of the type previously described, particularly useful for motor vehicle doors which may be produced at low cost, which will not influence the structural dimensioning of the hinge and which will be automatically effective and provide absolute security when the vehicle door is reinstalled, the device of the invention ensuring that a nonrotative connection is produced between the hinge eye of the second or removable hinge half of the hinge pin when the vehicle door is replaced on the hinges.

SUMMARY OF THE INVENTION

Briefly, the present invention may be described as a door hinge assembly for motor vehicles particularly adapted to enable removal and replacement of the vehicle door during assembly of the vehicle comprising: a first and a second hinge member, each having a hinge eye; a hinge pin; bushing means mounting the eye of the first hinge part on the hinge pin in relative rotative engagement while preventing relative axial displacement therebetween; toothed means interposed between the hinge pin and the eye of the second hinge part effecting rotative interlocking therebetween while enabling relative axial displacement to permit the second hinge part to be dismounted from and remounted on the hinge pin during assembly of the vehicle; recess means in the hinge pin; carrier means arranged in the eye of the second hinge member projecting into the recess means of the hinge pin to effect a nonrotatable connection between the second member and the hinge pin; and spring means interposed between the second hinge member and the carrier means urging the carrier means into engagement within the recess means.

As a result of the present invention, the carrier means are arranged at the second or removable hinge member so as to be displaceable against a spring load and so as to project into the borehole of the second hinge eye, the carrier means engaging into the recesses in the hinge pin when the hinge is assembled to produce a nonrotative connection.

The carrier means may be constructed in various ways, but they are preferably accommodated within the hinge eye borehole of the eye of the second removable hinge member.

In a preferred embodiment, the carrier means may be formed of a single carrier part which is axially displaceable against the load of a compression or pressure spring and which cooperates with a single recess formed in the portion of the hinge pin engaging in the eye of the second hinge member. The compression spring and the carrier part are thereby arranged so as to be parallel and concentric respectively relative to their axes in the borehole of the eye of the second hinge member. Particularly, the carrier part can be formed by means of a flat material blank and may be displaceably guided in axially directed slot recesses in the second hinge member, which slot recesses are radially connected to the hinge eye borehole so as to be parallel to the axis of the hinge eye borehole.

A slot recess in the end face of the hinge pin portion engaging in the second hinge half is assigned for cooperation with a part of the carrier means formed of a flat material blank, which part has a shaft portion enclosed by the compression spring, a guide portion connected to the shaft portion and two lateral projections engaging in guide slots formed in the hinge eye and, finally, a locking portion.

The compression spring loading the carrier means is preferably formed of a spiral spring and is arranged within the borehole of the hinge eye of the second hinge member and is supported by means of at least one support provided in the area of the external end face of the eye of the second hinge member. The supporting means for the compression spring which loads the carrier part may be constructed in various ways. In a preferred embodiment, which is particularly simple in terms of the manufacturing processes involved, support of a compression spring may be provided by means of two projections which project into the borehole of the hinge eye and which are produced by means of notches formed so as to lie opposite one another in the external end face of the eye of the second hinge member directly adjacent to the circumference of the borehole thereof.

In order to provide a more uniform support of the compression spring, a compression or pressure distributor disk may be provided, in accordance with a further embodiment of the invention, between the projections which project into the hinge eye borehole and the compression spring.

In accordance with a further embodiment of the invention, the carrier part is formed of a solid material portion provided with an axially directed circumferential profiling and the inner circumference of the borehole of the hinge eye of the second hinge member is likewise provided in the area of the carrier part along a part of the length of the hinge eye borehole with a correspondingly axially directed circumferential profiling in such a manner that an interlocking nonrotatable connection is produced between the carrier member or part and the hinge eye of the second or removable hinge half.

The compression spring loading the carrier means may likewise be structured as a spiral spring and, in order to conserve space, it is at least partially received in a central pocket or blind borehole of the carrier means. At its end facing the hinge pin, the carrier member has at least one axially directed web projection to which there is cooperatively assigned at least one slot recess in the end face of the hinge pin portion engaging in the hinge eye borehole of the second removable hinge half.

In order to improve the mutual interlocking engagement between the hinge pin and the carrier member during the first rotative movement of the replaced door, it may additionally be provided that the carrier part has a plurality of axially directed web projections, in particular, two axially directed web projections, arranged so as to be perpendicular relative to one another and located to engage in axially directed slot recesses which are correspondingly arranged in the end face of the portion of the hinge pin engaging in the hinge eye borehole of the second hinge member.

Additionally, in a special embodiment of the invention, the slot recesses in the end face of the hinge pin portion projecting into the hinge eye borehole of the second hinge member serve to further facilitate the mutual engagement of the hinge pin and the carrier part in that these slot recesses widen increasingly from the hinge pin axis to the hinge pin circumference.

In accordance with a further preferred embodiment of the invention, instead of providing axially directed projections and slot recesses alternately arranged between the carrier part and the end face of the hinge pin, there are instead provided a recess and a projection with a polygonal cross-sectional configuration arranged at the end faces of the carrier part and of the hinge pin portion which projects into the borehole of the eye of the second hinge member, with the end faces being in opposed relationship so as to alternate and so as to be concentric relative to the hinge axis. Of course, other cross-sectional configurations deviating from a pure circular form could be provided to ensure a nonrotative connection, for example, an oval cross-sectional form, corresponding to a polygonal cross-sectional form.

In accordance with further characteristics of the invention, it may also be provided that the carrier part is formed to completely fill the cross-section of the borehole of the hinge eye and so that the carrier part is constructed to form more than one part, in particular four or six parts, with the parts of the carrier part combining to form a cylindrical body.

The purpose which is sought to be attained by means of the structure of the removable door hinge in accordance with the invention is achieved in an adequate manner when, in a suspension for a vehicle door consisting of two unhingeable or removable door hinges, only one of the two unhingeable door hinges is equipped with a spring-loaded carrier part in accordance with the invention.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there are illustrated and described preferred embodiments of the invention.

DETAILED DESCRIPTION OF THE PREFERRED EMBODIMENTS

Figure 1:
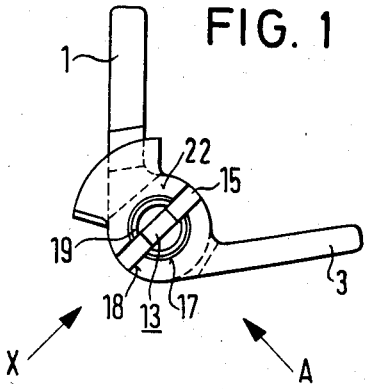
FIG. 1 is a top view of a hinge assembly in accordance with the present invention.
Figure 2:
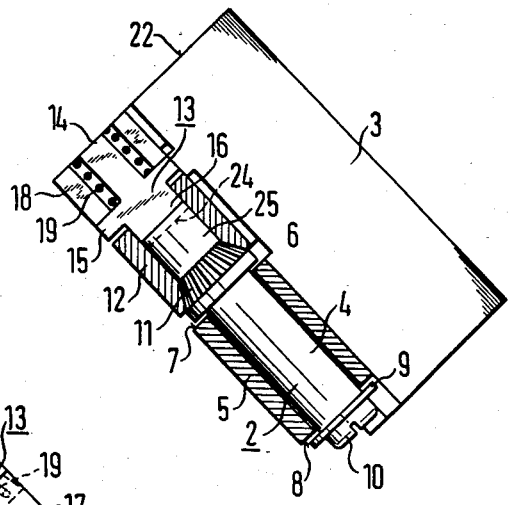
FIG. 2 is a longitudinal sectional view of the hinge assembly of FIG. 1.
Figure 3:
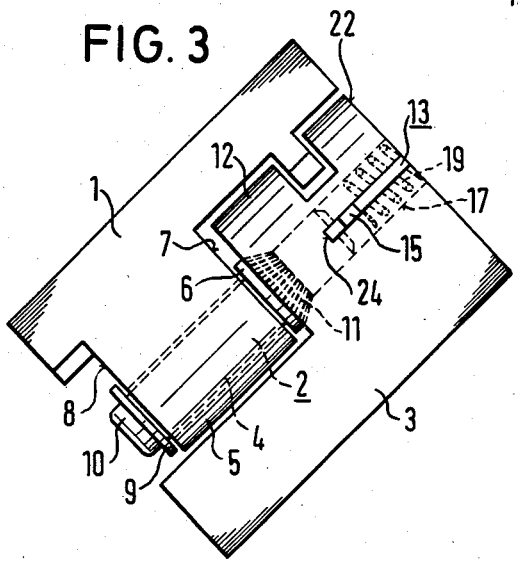
FIG. 3 is a front view of the assembly shown in FIGS. 1 and 2.

Referring now to the drawings and more particularly to FIGS. 1–3, there is shown a first embodiment of a hinge assembly in accordance with the present invention which consists essentially of a first hinge half or member 1 which may be attached, for example, by means of welding or the like, at a door mounting part (not shown) of a motor vehicle and a second hinge half or member 3 which is connected with the member 1 by means of a hinge pin 2. The second hinge member 3 may, in turn, be connected also by means of welding or the like at another door mounting part (also not shown) which may be part of the door itself which is to be mounted.

The hinge pin 2 is supported so as to be freely rotatable within the hinge member 1 in a maintenance-free manner and with a running fit by means of the bearing bush 4 which is structured as a collar bush. The hinge pin 2 is secured against axial travel or movement relative to the hinge member 1 within a hinge eye 5 of the member 1 in that, on the one hand, the pin is formed with a radially projecting collar 6 with which it overlaps the upper end face 7 of the hinge eye 5 and, on the other hand, by overlapping the lower end face 8 of the hinge eye 5 with an intermediary of a disk 9 by means of a head 10.

At its upper face, the collar 6 of the hinge pin 2 is provided with a radially directed toothed profiling which is shaped in the form of a conical toothed wheel arranged in the configuration of a truncated cone. The hinge member 3 is formed with a hinge eye 12 which is internally configured with a corresponding or complementary toothed profile which likewise consists of alternating consecutive projections or raised portions and recesses engaging the toothed profiling 11 on the collar 6. The profiling 11 and the complementary profiling in the hinge eye 12 on the second hinge member 3 form a mutual nonrotative interlocking engagement between the pin 12 and the hinge member 3 as soon as they are engaged relative to each other.

However, since a mutual interlocking of the two toothed surfaces or parts cannot be absolutely ensured after the first, or after one of the first, rotative movements of the hinge when the vehicle door is being replaced on the hinge, the hinge assembly is equipped in addition to the toothed profiling with a springloaded carrier means for the hinge pin 2. The carrier means is the member 13, as shown in the embodiment of FIGS. 1–3.

In the embodiment shown in FIGS. 1–3, the carrier means or member 13 is spring-loaded and comprises a shaft part 14, a guide portion having a laterally projecting guide part 15 and an engagement or contact portion 16. The carrier member 13 is formed from a single flat material blank and is arranged so as to be axially displaceable within a borehole 17 of the hinge eye 12 of the second or removable hinge member 3.

The carrier member 13 engages by means of its projections 15 in axially directed guide slots 18 which radially adjoin the hinge eye borehole 17 by means of which it is connected with the hinge eye 12 of the member 3 so as to be secured against relative rotation with regard thereto. The carrier member 13 is loaded in the axial direction by means of a compression spring 19 which encloses the shaft part 14. The spring 19 is accommodated in its entire length in the borehole 17 of the hinge eye 12 and is constructed in the form of a spiral spring. The spring 19 is supported at its upper end against projections 20 which extend into the hinge eye borehole 17 and which are in turn formed by means of notches 21 formed in the end face 22 of the hinge eye 12 directly adjacent to the circumference of the hinge eye borehole 17.

Figure 4:
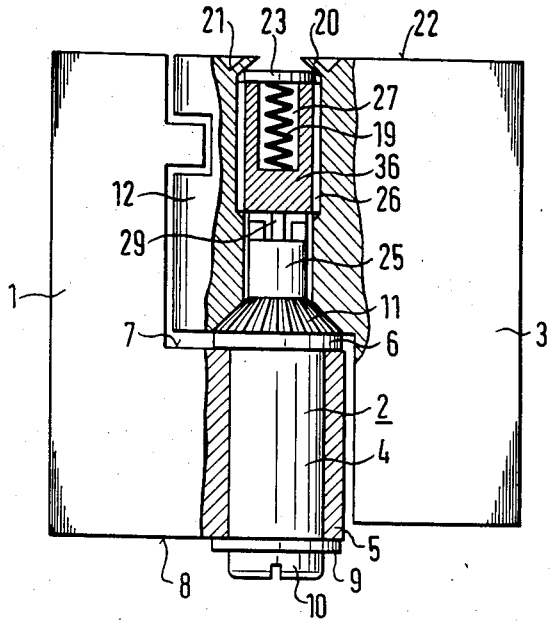
FIG. 4 is a longitudinal sectional view showing another embodiment of the assembly in accordance with the invention.
Figure 8:
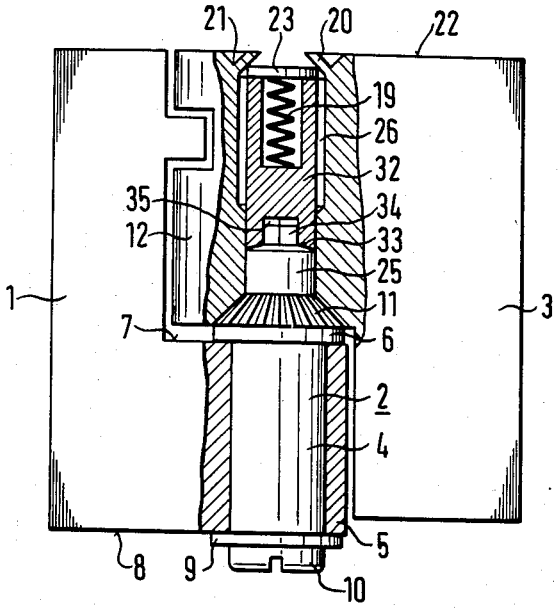
FIG. 8 is a longitudinal sectional view showing a further embodiment of the invention.

In the embodiment of the invention shown in FIGS. 4 and 8, a pressure distributor disk 23 is provided and as will be seen from FIGS. 4 and 8, the spring 19 is supported by the projections 20 through the intermediary of the pressure distributor disk 23.

As shown in FIG. 1, the carrier member 13 is formed with a lower engagement or contact portion 16 and the upper portion 25 of the hinge pin 2 which extends into the eye 12 of the second hinge member 3 is formed with a recess 24. The engagement portion 16 engages in the axially directed slot or recess 24 in the upper portion 25 of the hinge pin 2 in the manner indicated in the drawing.

Figure 5:
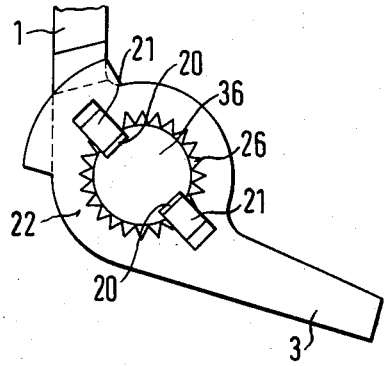
FIG. 5 is a top view of the assembly shown in FIG. 4.

In the embodiment shown in FIGS. 4 and 5, there is provided a carrier member 13A which is shaped in the form of a solid material member which entirely fills the hinge eye borehole 17. The carrier member 13A is nonrotatively connected with the hinge eye 12 of the second removable hinge member 3 by means of an axially directed circumferential toothed profiling 26 which engages in an interlocking manner with a corresponding or complementary profiling on the inner circumference of the hinge eye borehole 17. The compression spring 19, which loads the carrier member 13A in the axial direction, is received in a pocket or borehole 27 formed in the carrier member 13A and it is supported against the projections 20 which extend into the hinge eye borehole 17 against the compression distributor disk 23.

Figure 7:
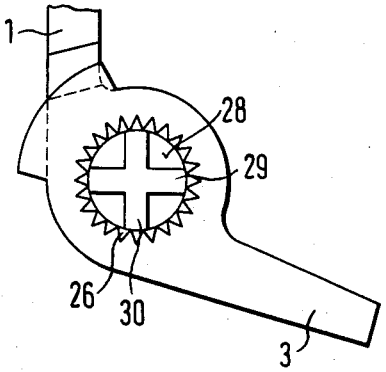
FIG. 7 is a top view of another constructional form of the end face of a hinge pin cooperating with the carrier means in the hinge eye borehole of the second or removable hinge member.

The carrier member 13A has an end face 28 at which there are formed axially directed web projections 29 and 30 which extend perpendicularly relative to each other and which are arranged to be engaged within slot recesses 31 in the upper end face of the portion 25 of the hinge pin 2. This embodiment of the invention is particularly shown in FIG. 7.

Figure 6:
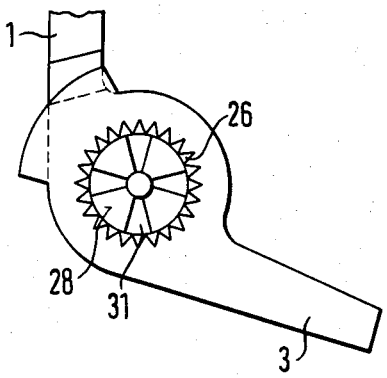
FIG. 6 is a top view of a possible structural form of the end face of the hinge pin portion of the hinge assembly according to FIG. 4, which hinge pin portion engages in the removable or unhingeable second hinge member.

In an embodiment of the invention shown in FIG. 6, there are provided slot recesses 31 which are constructed in such a manner that they tend to widen with an increasing dimension from the axis of the hinge pin radially outwardly toward the circumference thereof. Of course, the carrier member 13A may be formed with similarly shaped projections for engagement in the recesses 31.

Thus, as a result of the interengagement of the lower projections on the carrier member 13A into the recesses formed in the upper face of the part 25 of the hinge pin 2, there is facilitated a locking of the projections into the recesses, for example, by engagement of the axially directed web projections 29 and 30 of the carrier member 13A into the slot recesses 30 or 31 of the part 25 of the pin 2.

Figure 9:
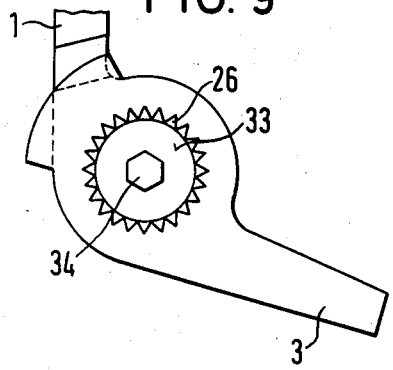
FIG. 9 is an end view showing the lower end face of the carrier means of the assembly shown in FIG. 8.

In FIGS. 8 and 9, there is shown a further embodiment of the invention, wherein a carrier member 32 is provided which is formed at the lower end thereof with a recess 35 into which there engages a peg 34 which extends from the portion 25 of the hinge pin 2 beyond an axial end face 33 thereof. The carrier member 32 is axially spring-loaded by the spring 19 and is connected with the hinge eye 12 of the second removable hinge member 3 by axially directed circumferentially extending teeth or profiles 26 so as to be secured against relative rotation, but also so as to be axially displaceable.

Accordingly, the carrier member 32 also will have the axial recess 35, and the peg 34 and the recess 35 are formed with corresponding polygonal cross-sectional configurations. By means of the reciprocal arrangement of the axially directed projection 33 and the axially directed recess 35 with the cross-sectional form diverging from a pure circular form, a nonrotative connection is produced between the carrier member 32 and the hinge pin portion 25 when the vehicle door is replaced on the hinge assembly in the course of its first swivelling movement. This nonrotative connection ensures a nonrotative connection between the hinge pin 2 and the hinge member 3 as a result of the nonrotative fixing of the carrier part 32 in the hinge eye borehole 17 of the hinge eye 12 of the second hinge member 3.

In addition to the foregoing, it will also be seen that the hinge assembly of the invention is provided with means which prevent axial relative displacement of the hinge members 1 and 3 within a certain rotative angle or range. As shown, particularly with reference to FIGS. 1–3, but as also shown in FIGS. 4 and 8, the hinge member 1 is provided with a projection 1A and the hinge member 3 is provided with a recess 3A and, as a result of their interengagement, the hinge halves are locked together in the axial direction along only a predetermined operating swivel angle by the reciprocally arranged projections and recesses 1A, 3A which are defined in the circumferential direction and engage in one another over the operating swiveling angle area of the hinge.

Thus, in accordance with the foregoing, it will be seen that the present invention provides a door hinge assembly for motor vehicles having one hinge half which is supported on the hinge pin in a hinge eye by means of a bushing of bearing material with a running fit so as to be maintenance-free, but so as to be secured against displacement in the axial direction. The other hinge half is mounted on the projecting or overlapping portion of the hinge pin by means of the hinge eye. The hinge pin has a radial projection which is provided with a profiling and a hinge eye of the mountable hinge half as a counter-profiling for the purpose of a nonrotatable mutual engagement between the hinge pin and the other hinge half. In order to ensure a support of the hinge pin already during the first swivelling movement of the hinge joint, it is provided that a spring-loaded carrier which achieves a locking interengagement with the hinge pin be arranged in the hinge eye of the other or removable hinge half.

While specific embodiments of the invention have been shown and described in detail to illustrate the application of the inventive principles, it will be understood that the invention may be embodied otherwise without departing from such principles.

What is claimed is

1. A door hinge assembly for motor vehicles particularly adapted to enable removal and replacement of a vehicle door during assembly of the vehicle comprising:

a first and a second hinge member each having a hinge eye;

a hinge pin;

bushing means mounting said eye of said first hinge part on said hinge pin enabling relative rotative motion but preventing relative axial movement therebetween;

toothed means interposed between said hinge pin and said eye of said second hinge member effecting rotative interlocking therebetween while enabling relative axial displacement to permit said second hinge member to be dismounted from and remounted on said said hinge pin during assembly of a vehicle;

means securing said first and second hinge members against relative axial displacement through a predetermined operating angle;

recess means in said hinge pin;

carrier means arranged in said eye of said second hinge member projecting into said recess means to effect nonrotatable relative engagement between said second hinge part and said hinge pin; and spring means interposed between said second hinge member and said carrier means urging said carrier means into engagement within said recess means.

2. An assembly according to claim 1, wherein said carrier means are formed of a single carrier member which is axially displaceable against the load of said spring means and which cooperates with a single recess in a portion of said hinge pin engaging in said second hinge member.

3. An assembly according to claim 2, wherein said hinge eye of said second hinge member is formed with a hinge eye borehole and wherein said spring means and said carrier means are arranged in said hinge eye borehole so as to be parallel and concentric respectively relative to their axes.

4. An assembly according to claim 1 further comprising axially directed guide slots formed in said second hinge member and a hinge eye borehole formed in said hinge eye of said second hinge member, said carrier member being formed as a flat material blank which is displaceably guided in said axially directed guide slots, said guide slots radially adjoining said hinge eye borehole so as to be parallel to the axis of said hinge eye borehole.

5. An assembly according to claim 1, wherein said hinge pin includes a portion thereof engaging in said hinge eye of said second hinge member and wherein said recess means comprises a slot recess assigned to said carrier means.

6. An assembly according to claim 4, wherein said flat material blank has a shaft portion enclosed by said spring means as well as a guide portion adjoining said shaft portion and having two lateral projections engaging in said guide slots of said hinge eye of said second hinge member, with a locking portion being provided engaging in said recess means in said hinge pin.

7. An assembly according to claim 1, wherein said spring means comprise a spiral spring arranged within said hinge eye of said second hinge member, said spiral spring being supported by at least one support provided in the area of an external end face of said hinge eye of said second hinge member.

8. An assembly according to claim 7, wherein said support for said spiral spring is formed by projections formed in said hinge eye of said second hinge member which are provided by notches arranged so as to lie opposite one another in said external end face of said hinge eye of said second hinge member directly adjacent a circumference of a borehole in said hinge eye.

9. An assembly according to claim 7, further comprising a pressure distributor disk engaged between said spiral spring and said support.

10. An assembly according to claim 1, wherein said carrier means comprises a carrier part formed as a solid material portion provided with an axially directed circumferential toothed profiling and wherein said hinge eye of said second hinge member is formed with a borehole having an inner circumference which is formed in the area of said carrier part along a part of its length with a correspondingly axially directed circumferential toothed profiling engaging said toothed profiling in said carrier part.

11. An assembly according to claim 10, wherein said carrier part is formed with an axially extending central pocket and wherein said spring means is in the form of a spiral spring received at least in part in said central pocket.

12. An assembly according to claim 11, wherein said hinge pin has a portion extending into said hinge eye of said second hinge member with an end face having said recess means formed therein and wherein said carrier member has at least one axially directed web projection engaging into said recess means in said end face of said hinge pin portion engaging in said hinge eye of said second hinge member.

13. An assembly according to claim 12, wherein said carrier part has a plurality of axially directed web projections arranged so as to be perpendicular relative to each other and wherein said recess means comprise axially directed slot recesses which are arranged correspondingly in the end face of said hinge pin portion engaging in said hinge eye of said second hinge member.

14. An assembly according to claim 13, wherein at least one of said slot recesses is formed with a dimension which widens in a direction extending radially outwardly of said hinge pin from the center thereof.

15. An assembly according to claim 1, wherein said hinge eye of said second hinge member is formed with a hinge eye borehole, wherein said carrier means is configured to completely fill the cross-section of said hinge eye borehole and wherein said carrier means is constructed so as to consist of more than one part taken in the axial direction, said parts of said carrier means together forming a cylindrical body.

16. An assembly according to claim 1, wherein said carrier means is formed with a projection having a polygonal cross-sectional configuration and wherein said recess means comprise a recess having a polygonal configuration conforming with said projection, said recess and said projection being alternately and concentrically arranged relative to an axis of said hinge pin at the end faces of said carrier part and of said hinge pin projecting into said hinge eye of said second hinge half which faces are opposed to each other.

17. An assembly according to claim 1, wherein only one of said hinge members is equipped with carrier means.

* * * * *